US006037845A

United States Patent [19]

Parker

[11] Patent Number: 6,037,845

[45] Date of Patent: Mar. 14, 2000

[54] RF THREE-WAY COMBINER/SPLITTER

[75] Inventor: Gerry Allen Parker, Trophy Club, Tex.

[73] Assignee: Nokia Telecommunications, OY, Espoo, Finland

[21] Appl. No.: 08/995,760

[22] Filed: Dec. 22, 1997

[51] Int. Cl.[7] ..... H01P 5/12

[52] U.S. Cl. ..... 333/128; 333/238

[58] Field of Search ..... 333/127, 128, 333/136

[56] References Cited

U.S. PATENT DOCUMENTS

| | | | |
|---|---|---|---|
| 3,091,743 | 5/1963 | Wilkinson | 333/127 |
| 3,219,949 | 11/1965 | Heeren . | |
| 3,678,415 | 7/1972 | Kuroda | 333/128 X |
| 4,254,386 | 3/1981 | Nemit et al. | 333/128 |
| 4,367,445 | 1/1983 | Dydyk | 333/127 |
| 4,956,621 | 9/1990 | Heckaman et al. | 333/128 X |
| 5,430,418 | 7/1995 | Blodgett | 333/100 |

*Primary Examiner*—Paul Gensler
*Attorney, Agent, or Firm*—Altera Law Group, LLC

[57] ABSTRACT

An RF three-way combiner/splitter is disclosed that can be fabricated in a single signal layer on a PCB and which has better separation of the outputs and improved location of ballast resistors. The combiner/splitter includes seven one-quarter wave-length trace segments joined to form a structure in a general shape of a figure eight. The seven one-quarter wave-length trace segments connect to form six connection ports, wherein a first and second connection port is above and below a central input port and three output ports are disposed on the opposite side of the structure. A first ballast resistor is coupled to the first connection port and a second ballast resistor is coupled to the second connection port. The trace segments may be straight or some of the trace segments may be folded to decrease the physical length of the combiner/splitter.

17 Claims, 5 Drawing Sheets

RF THREE-WAY COMBINER/SPLITTER

BACKGROUND OF THE INVENTION

1. Field of the Invention

This invention relates in general to an electric circuit design, and more particularly to an RF three-way combiner/splitter.

2. Description of Related Art

Radio frequency power dividers have many applications, some of which impose more stringent operational characteristics than others. In the field of phased arrays, for example, it is desirable to divide an input signal into a plurality of equi-phase, equi-amplitude, non-interacting signal outputs, the number of outputs being odd or even in accordance with the requirements of a particular system.

Accordingly, a passive power combiner/splitter may be required in electronics circuit design for either combining two or more signals, or for dividing a single signal into two or more components. Passive power combiner/splitters in the prior art, such as the "Wilkinson" power divider, are too large and too expensive for some applications. Prior designs of three way combiner/splitters also required at least two printed circuit board (PCB) layers. Further, alternative combiner/splitter structures are characterized by the outputs being spaced close together. Furthermore, prior designs have the ballast resistors near the connections to connecting circuitry. This requires additional line lengths to make the connections to circuitry.

It can be seen that there is a need for a three-way combiner/splitter that provides improved separation of the outputs to facilitate connections.

It can also be seen that there is a need for a three-way combiner/splitter that includes ballast resistors located away from the outputs.

It can also be seen that there is a need for a three-way combiner/splitter that can be fabricated in a single signal layer on a PCB.

SUMMARY OF THE INVENTION

To overcome the limitations in the prior art described above, and to overcome other limitations that will become apparent upon reading and understanding the present specification, the present invention discloses an RF three-way combiner/splitter.

The present invention solves the above-described problems by providing an RF three-way combiner/splitter that can be fabricated in a single signal layer on a PCB and which has better separation of the outputs and improved location of ballast resistors.

A system in accordance with the principles of the present invention includes seven one-quarter wave-length trace segments joined to form a structure in a general shape of a figure eight. The seven one-quarter wave-length trace segments connect to form six connection ports, wherein a first and second connection port are above and below a central input port and three output ports are disposed on the opposite side of the structure. A first ballast resistor is coupled to the first connection port and a second ballast is coupled to the second connection port.

Other embodiments of a system in accordance with the principles of the invention may include alternative or optional additional aspects. One such aspect of the present invention is that the trace segments are straight.

Another aspect of the present invention is that the seven one-quarter wave-length trace segments joined to form a structure in a general shape of a figure eight comprise a first and second trace segment connected end-to-end forming a left side of the figure eight, a third and fourth trace segment connected end to end forming a right side of the figure eight, a top trace segment forming a top of the figure eight, a bottom trace segment forming a bottom of the figure eight and a center trace segment forming a center cross segment of the figure eight.

Yet another aspect of the present invention is that the first, second, third and fourth trace segments have an impedance characteristic of fifty-five ohms.

Another aspect of the present invention is that the top trace segment and the bottom trace segment each have an impedance characteristic of twenty-five ohms.

Another aspect of the present invention is that the center trace segment has an impedance characteristic of twenty-two ohms.

Another aspect of the present invention is that the central input port and the three output ports have a fifty ohm input impedance.

Another aspect of the present invention is that the first and second ballast resistors have a thirty ohm impedance.

Still another aspect of the present invention is that the three output ports include a top, center, and bottom output port, the center output port including a phase characteristic that leads the top and bottom output ports by ninety degrees.

Another aspect of the present invention is that the seven one-quarter wave-length trace segments and the first and second ballast resistors are coplanar.

Another aspect of the present invention is that the RF three-way combiner/splitter further includes a loss characteristic between the central input port and each of the three output ports of less than −4.9 decibels.

Another aspect of the present invention is that the three output ports further comprise a port-to-port isolation of more than 17 decibels.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout.

DETAILED DESCRIPTION OF THE INVENTION

In the following description of the exemplary embodiment, reference is made to the accompanying drawings which form a part hereof, and in which is shown by way of illustration the specific embodiment in which the invention may be practiced. It is to be understood that other embodiments may be utilized as structural changes may be made without departing from the scope of the present invention.

Figure 1:
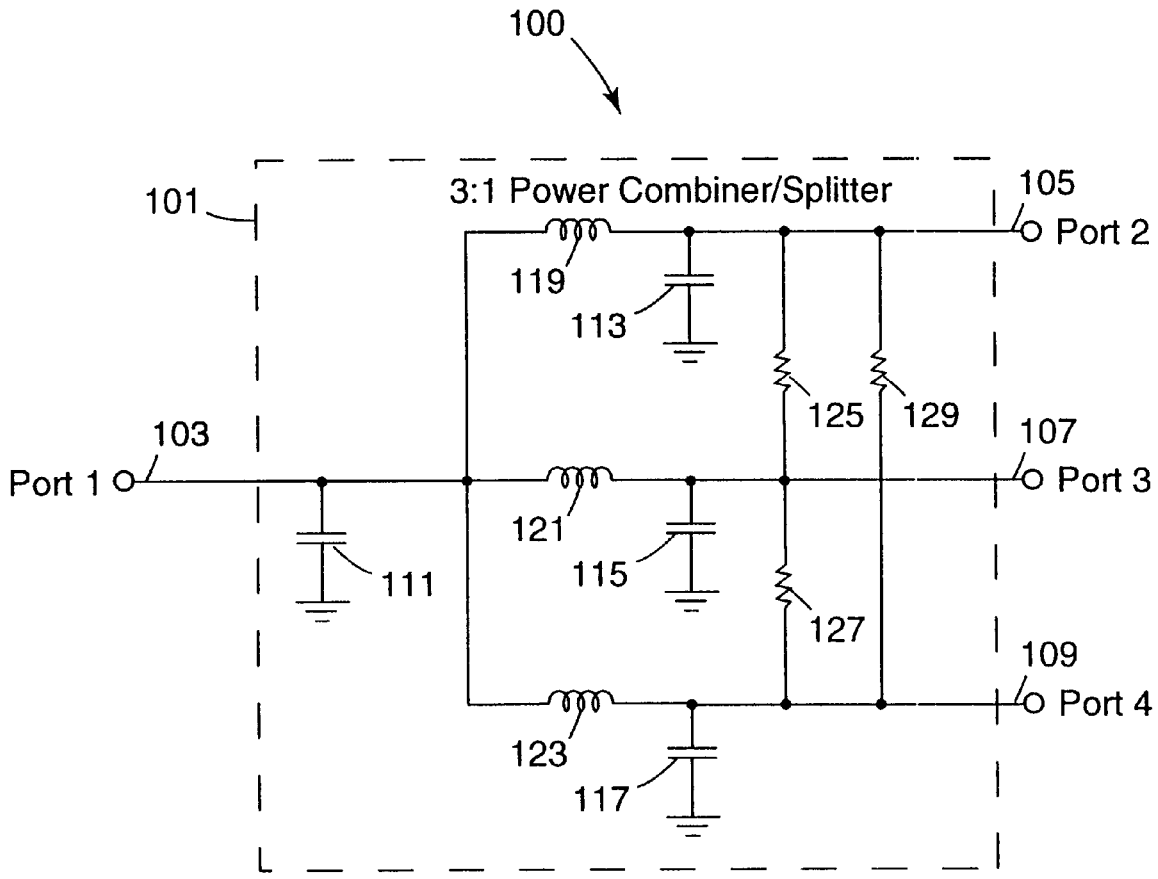
Fig. 1 Prior Art
FIG. 1 illustrates a three-way combiner/splitter 100 according to the prior art.

The present invention provides an RF three-way combiner/splitter that can be fabricated in a single signal layer on a PCB and which has better separation of the outputs and improved location of ballast resistors FIG. 1 illustrates a three-way combiner/splitter 100 according to the prior art. In FIG. 1, the three-way combiner/splitter 100 includes ten lumped elements: capacitor 111, capacitor 113, capacitor 115, capacitor 117, inductor 119, inductor 121, inductor 123, resistor 125, resistor 127 and resistor 129.

When the characteristic impedance of the three-way combiner/splitter is desired to be $Z_0$ ohms at each port, the value of each resistor is equal to $3Z_0$ ohms. The capacitance of capacitor 111 is equal to three times the capacitance of either capacitor 113, capacitor 115 or capacitor 117, which are the same value. When a narrowband signal with a center frequency of $\omega_0$ radian/second is fed into the three-way combiner/splitter, the capacitance of capacitor 113, capacitor 115 and capacitor 117 is:

$$C = \frac{1}{Z_0\omega_0\sqrt{N}} \text{ Farads}$$

where N is equal to the number of ports in an N-way splitter/combiner, i.e., 3 in this example, and the inductance of inductor 117 and inductor 119 is:

$$L = \frac{Z_0\sqrt{N}}{\omega_0} \text{ Henrys.}$$

However, the three-way combiner/splitter 100 of FIG. 1 does not provide good separation of the outputs to facilitate connections. Further, the three-way combiner/splitter 100 of FIG. 1 includes ballast resistors located at the outputs. Finally, three-way combiner/splitter 100 of FIG. 1 cannot be fabricated in a single signal layer on a PCB.

Figure 2:
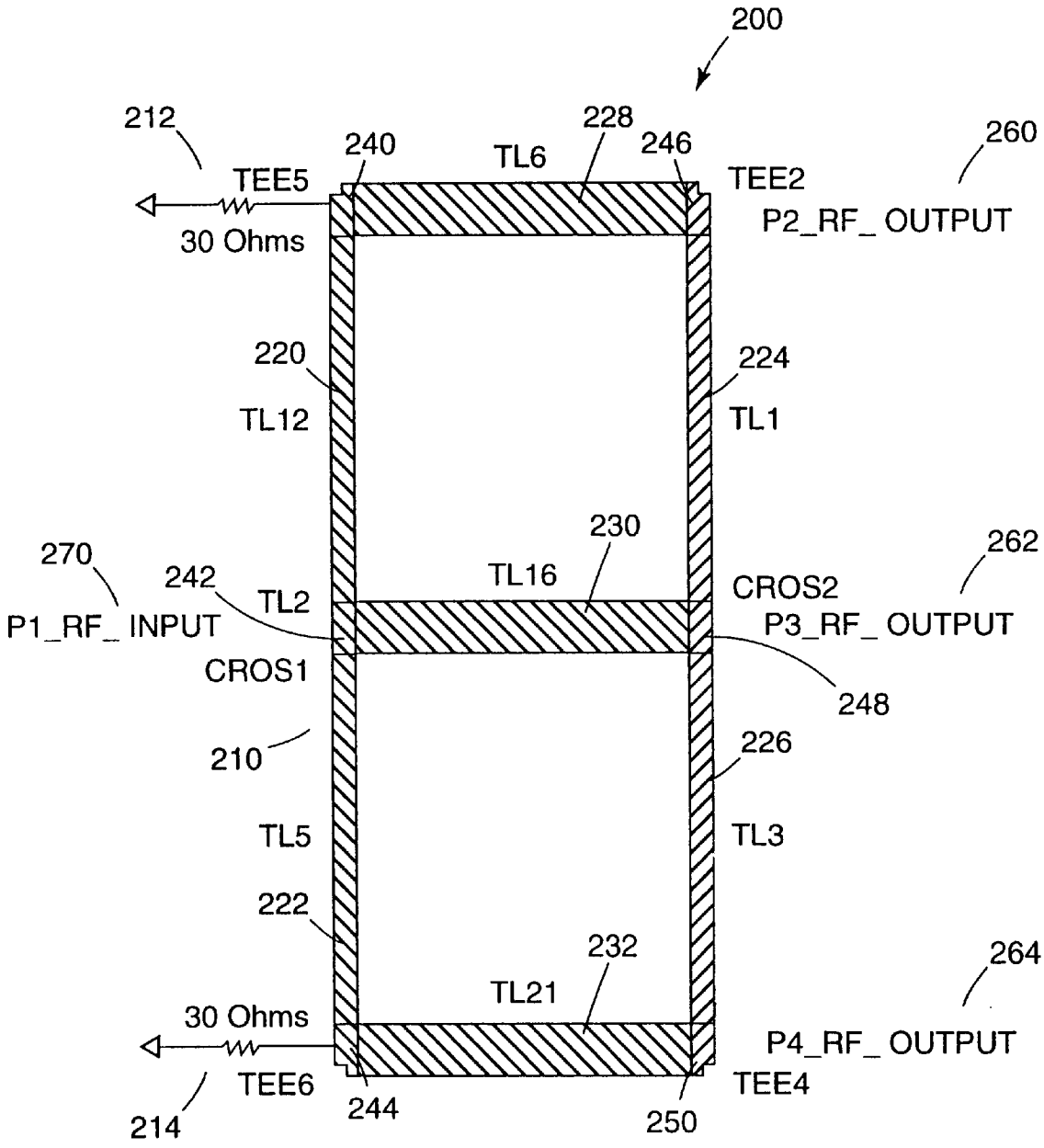
FIG. 2 illustrates a three-way combiner/splitter 200 according to the invention.

FIG. 2 illustrates a three-way combiner/splitter 200 according to the invention. The printed circuit board structure 200 combines RF from three separate channels, or splits RF equally to three separate channels. The structure 200 is achieved through the use of etched traces 210 on the PCB and two load ballasting resistors 212, 214. The device 200 functions by splitting the RF through (roughly) ¼ wavelength structures 210 connected in such a way that phasing, line impedance, and ballasting resistors 212, 214 preserve the desired electrical characteristics and is explainable by means of transmission line theory.

The three-way combiner/splitter 200 according to the invention is physically smaller than any other known alternative on equivalent dielectric substrates. Furthermore, prior combiner/splitter designs either accomplish only two-way splits, or require multiple layers.

FIG. 2 illustrates that the etched traces 210 are composed of exactly seven approximately ¼ wavelength straight trace segments 220, 222, 224, 226, 228, 230, 232 joined in the general shape of the numeral "8". Four of the segments 220, 222, 224, 226 form the vertical outside edges of the structure, and the three remaining segments 228, 230, 232 form the horizontal parts of the structure. The three-way combiner/splitter 200 includes six connection ports 240, 242, 244, 246, 248, 250. A first connection port 270 is an RF input and is located at the left side on the center horizontal segment 230. The left side top 240 and bottom 244 corners are ballasting resistor connections. The top 246 and bottom 250 right side corners, and right center junction 248 of the center horizontal segment 230 are the three output RF ports: P2_RF_Output 260, P3_RF_Output 262, and P4_RF-Output 264.

The vertical four elements 220, 222, 224, 226 are of a characteristic RF impedance of about 55 ohms. The top 228 and bottom 232 horizontal elements are of about 25 ohms characteristic RF impedance. The center horizontal element 230 is of about 22 ohms characteristic RF impedance. The input port 270 and three output ports 260, 262, 264 are all of 50 ohms characteristic impedance and the terminating ballast resistors 212, 214 are about 30 ohms characteristic RF impedance.

Given that the input port 270 is Port 1, then there are three outputs, output Port 2 260, output Port 3 262, and Output Port 4 264, the phase of output Port 3 262 leads the other two ports 260, 264 by 90 degrees. Therefore, if equal phase is important, further phase compensation must be added. The structure 200 has about 0.15 dB insertion loss at 1960 Mhz.

The vertical separation between the output ports 260, 262, 264 provide for better connections since the outputs 260, 262, 264 feed straight into and out of components as opposed to Wilkinson type splitters where the outputs are physically close together and require extra line lengths to connect to circuitry. As shown in FIG. 1, in alternative combiner/splitter structures, i.e. Wilkinson 3-way combiner/splitters, placement of the ballasting resistors is also very inconvenient, and cannot be achieved on a single signal layer on a PCB. However, in the three-way combiner/splitter 200 according to the present invention, the ballasting resistors 212, 214 are placed well away from the outputs 260, 262, 264, and only two ballast resistors 212, 214 are required, rather than the typical (Wilkinson) three and all artwork, i.e., the ballast resistors 212, 214 and seven etched trace segments 220, 222, 224, 226, 228, 230, 232 are confined to a single signal layer.

Figure 3:
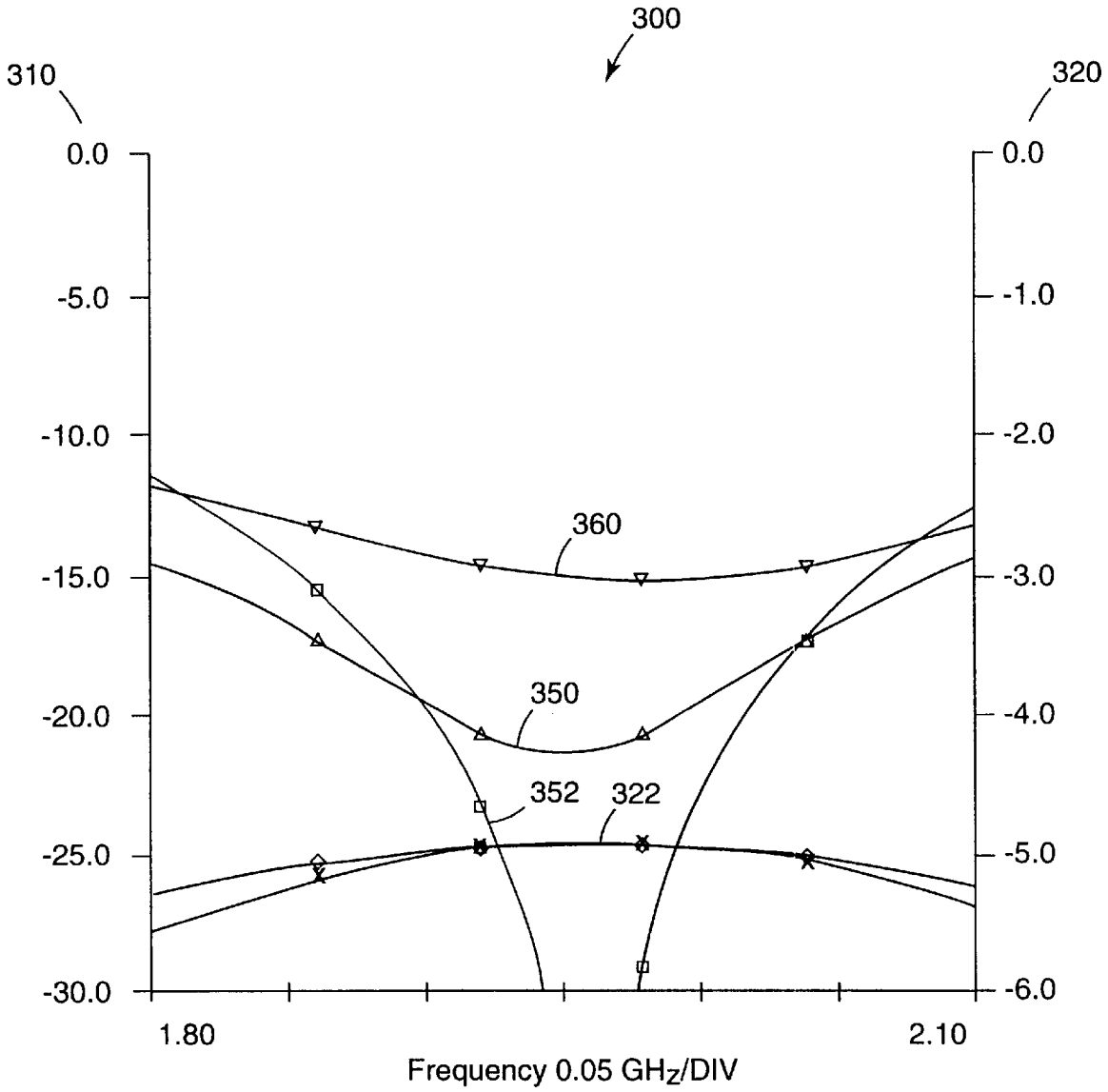
FIG. 3 illustrates the impedance match characteristics and port loss characteristics of the three-way combiner/splitter of FIG. 2.
Figure 4:
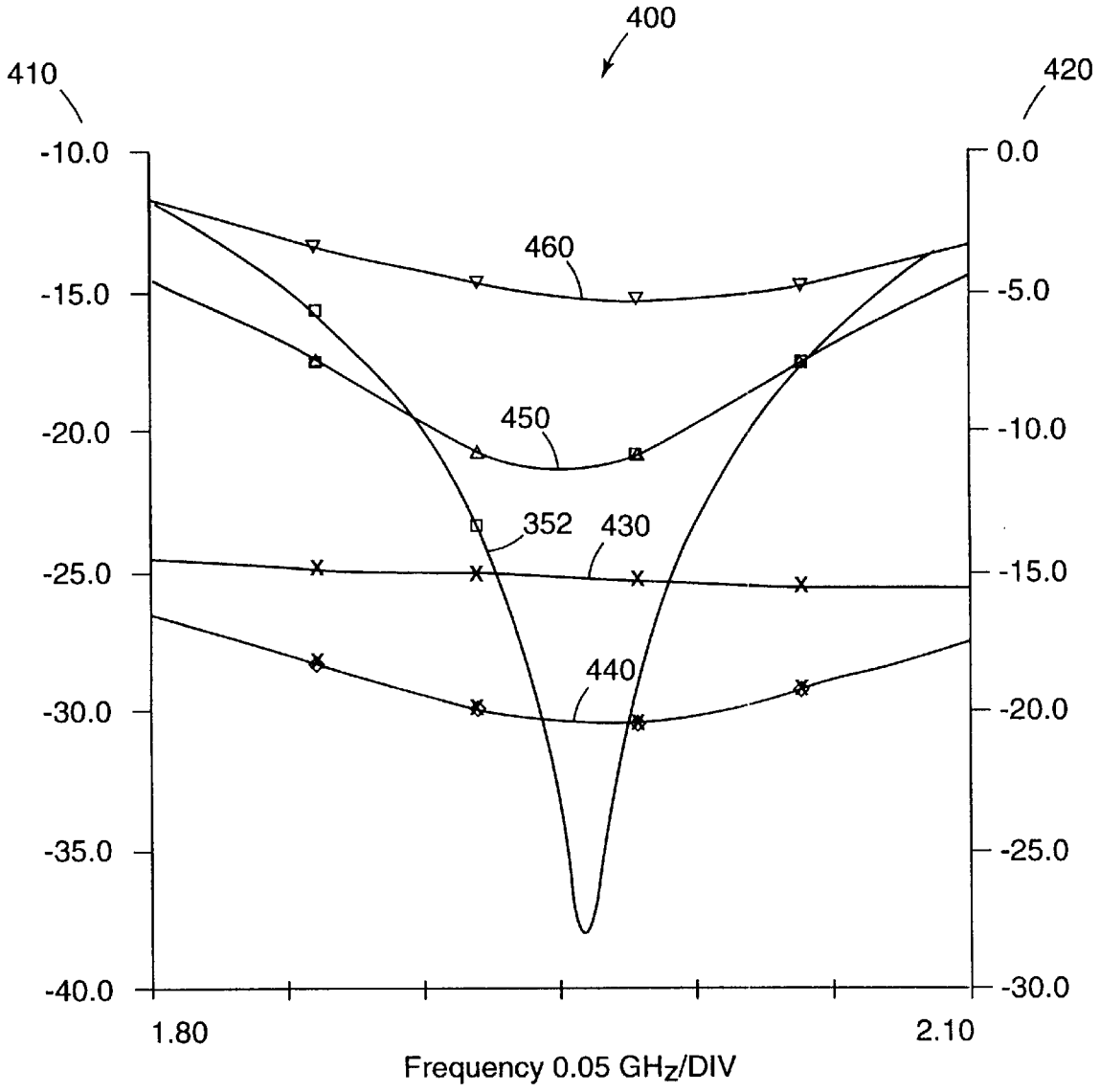
FIG. 4 illustrates the impedance match characteristics and the port-to-port loss of the three-way combiner/splitter of FIG. 2.

Referring to FIGS. 3 and 4, the performance characteristics 300, 400 of the three-way combiner/splitter will be described. In FIG. 3, the left y-axis 310 represents a measurement of how much a port appears to have a 50 impedance characteristic. The right y-axis 320 is a measurement of each port loss. Accordingly, reading the right y axis 320, FIG. 3 illustrates that the output ports are all −4.8 to −4.9 dB 322 from the input at 50 ohms, just as one would expect for a nearly lossless 3-way power split (an ideal lossless power split would be −4.78 dB).

In FIG. 4, as was shown in FIG. 3, the left y-axis 410 represents a measurement of how much a port appears to have a 50 impedance characteristic. The right y-axis 420 is measurement of the port-to-port loss. In FIG. 4, the output port-to-port isolation between port two and port four is −17 dB 430. The output port-to-port isolation between port two and port three, and between port three and port four is −20 dB min. 440.

As can be viewed from the left y-axis 310, 410 in either FIG. 3 or FIG. 4, the measured loss looking into port two or port four is −20 dB minimum 352, 452. The measured loss looking into port one is also −20 dB minimum 350, 450. Finally, the measured loss looking into port three is only −17 dB minimum 360, 460.

Figure 5:
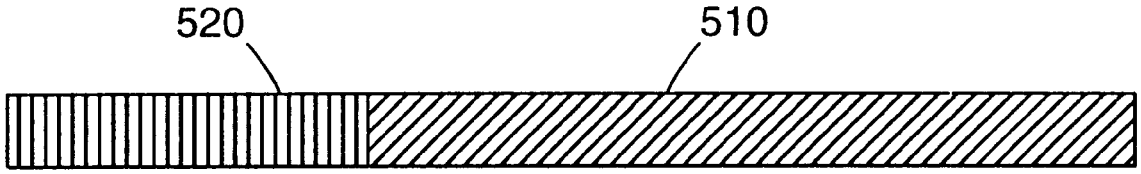
FIG. 5 illustrates the one-quarter wave-length trace segments and the ballast resistors being coplanar.

FIG. 5 illustrates the one-quarter wave-length trace segments 510 and the ballast resistors 520 being coplanar.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. An RF three-way combiner/splitter comprising:

seven one-quarter wave-length trace segments joined to form a structure in a general shape of a figure eight, the seven one-quarter wave-length trace segments connecting to form six connection ports, a first and second connection port being above and below a central input port and three output ports disposed on the opposite side of the structure; and a first and second ballast resistor, the first ballast resistor being coupled to the first connection port and the second ballast being coupled to the second connection port;

wherein the first, second, third and fourth trace segments comprise an impedance characteristic of fifty-five ohms, the top trace segment and the bottom trace segment each comprise an impedance characteristic of twenty-five ohms and the center trace segment comprises an impedance characteristic of twenty-two ohms.

2. The RF three-way combiner/splitter of claim 1 wherein the trace segments are straight.

3. The RF three-way combiner/splitter of claim 1 wherein the seven one-quarter wave-length trace segments joined to form a structure in a general shape of a figure eight comprise a first and second trace segment connected end-to-end forming a left side of the figure eight, a third and fourth trace segment connected end to end forming a right side of the figure eight, a top trace segment forming a top of the figure eight, a bottom trace segment forming a bottom of the figure eight and a center trace segment forming a center cross segment of the figure eight.

4. The RF three-way combiner/splitter of claim 1 wherein the central input port and the three output ports comprise a fifty ohm input impedance.

5. The RF three-way combiner/splitter of claim 1 wherein the first and second ballast resistors each comprise a thirty ohm impedance.

6. The RF three-way combiner/splitter of claim 1 wherein the three output ports comprise a top, center, and bottom output port, the center output port comprising a phase characteristic that leads the top and bottom output ports by ninety degrees.

7. The RF three-way combiner/splitter of claim 1 wherein the seven one-quarter wave-length trace segments and the first and second ballast resistors are coplanar.

8. The RF three-way combiner/splitter of claim 1 further comprising a loss characteristic between the central input port and each of the three output ports of less than −4.9 decibels.

9. The RF three-way combiner/splitter of claim 1 wherein the three output ports further comprise a port-to-port isolation of more than 17 decibels.

10. A method of fabricating an RF three-way combiner/splitter on a single signal layer of a printed circuit board, comprising the steps of:

forming seven one-quarter wave-length trace segments on a single signal layer on a printed circuit board to form a structure in a general shape of a figure eight, the seven one-quarter wave-length trace segments connecting to form six connection ports, a first and second connection port being above and below a central input port and three output ports disposed on the opposite side of the structure;

coupling a first ballast resistor to the first connection port; and coupling a second ballast to the second connection port;

wherein the first, second, third and fourth trace segments comprise an impedance characteristic of fifty-five ohms, the top trace segment and the bottom trace segment each comprise an impedance characteristic of twenty-five ohms, the center trace segment comprises an impedance characteristic of twenty-two ohms.

11. The method of claim 10 wherein the step of forming seven one-quarter wave-length trace segments further comprises the step of forming seven straight one-quarter wave-length trace segments.

12. The method of claim 10 wherein the step of forming the seven one-quarter wave-length trace segments further comprises the steps of connecting a first and second trace segment end-to-end to form a left side of the figure eight, connecting a third and fourth trace segment end to end forming a right side of the figure eight, connecting a top trace segment to the top of the left and right sides of the figure eight to form a top of the figure eight, connecting a bottom trace segment the bottom of the left and right sides of the figure eight to form a bottom of the figure eight and connecting a center trace segment centrally to the left and right sides of the figure eight to form a center cross segment of the figure eight.

13. The method of claim 10 wherein the central input port and the three output ports each comprise a fifty ohm input impedance.

14. The method of claim 10 wherein the first and second ballast resistor each comprise a thirty ohm impedance.

15. The method of claim 10 wherein the three output ports comprise a top, center, and bottom output port, the center output port comprising a phase characteristic that leads the top and bottom output ports by ninety degrees.

16. The method of claim 10 further comprising a loss characteristic between the central input port and each of the three output ports of less than −4.9 decibels.

17. The method of claim 10, wherein the three output ports further comprise a port-to-port isolation of more than 17 decibels.

* * * * *